US009126606B2

(12) United States Patent
Kuehs

(10) Patent No.: US 9,126,606 B2
(45) Date of Patent: Sep. 8, 2015

(54) METHOD FOR OPERATING A SWITCHING HUMP YARD, AND CONTROL DEVICE FOR A SWITCHING HUMP YARD

(75) Inventor: Peter Kuehs, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/233,994

(22) PCT Filed: Jul. 4, 2012

(86) PCT No.: PCT/EP2012/063017

§ 371 (c)(1),
(2), (4) Date: Jan. 21, 2014

(87) PCT Pub. No.: WO2013/010796

PCT Pub. Date: Jan. 24, 2013

(65) Prior Publication Data

US 2014/0144345 A1 May 29, 2014

(30) Foreign Application Priority Data

Jul. 20, 2011 (DE) ..... 10 2011 079 501

(51) Int. Cl.
*B61L 17/00* (2006.01)
*B61J 3/02* (2006.01)
(Continued)

(52) U.S. Cl.
CPC . *B61J 3/02* (2013.01); *B61H 11/00* (2013.01); *B61K 7/12* (2013.01); *B61L 17/00* (2013.01); *B61L 25/021* (2013.01)

(58) Field of Classification Search
CPC ..... B61H 1/00; B61H 11/00; B61H 15/00; B61J 3/02; B61K 7/12; B61L 25/021; B61L 17/00
USPC ..... 104/26.2; 701/20
See application file for complete search history.

(56) References Cited

U.S. PATENT DOCUMENTS 3,217,159 A * 11/1965 Auer, Jr. et al. ..... 246/182 A
3,244,874 A * 4/1966 Robison, Jr. ..... 246/4
(Continued)

FOREIGN PATENT DOCUMENTS

DE 1103377 3/1961
DE 1166811 B 4/1964
(Continued)

OTHER PUBLICATIONS

Kraft, Edwin; "The Yard"; 2002; Kalmbach Pub. Co.; Trains; vol. 62; pp. 36-47.*
(Continued)

*Primary Examiner* — Jerrah Edwards
*Assistant Examiner* — Tamara Weber
(74) *Attorney, Agent, or Firm* — Laurence A. Greenberg; Werner H. Stemer; Ralph E. Locher

(57) ABSTRACT

In a method for operating a switching hump yard, at least one value for an entry speed into a first retarder is ascertained for the respective cuts in the form of rolling cars or car groups for the first retarder on the basis of a target release speed from the first retarder. At least one value for a release speed from a second retarder that lies uphill relative to the first retarder is determined for the second retarder on the basis of the ascertained at least one value for the entry speed into the first retarder. The second retarder is controlled taking into account the determined at least one value for the release speed. I also describe a control device for controlling a hump yard.

15 Claims, 2 Drawing Sheets

(51) Int. Cl.

| | |
|---|---|
| ***B61K 7/12*** | (2006.01) |
| ***B61L 25/02*** | (2006.01) |
| ***B61H 11/00*** | (2006.01) |

(56) References Cited

U.S. PATENT DOCUMENTS

| | | | | |
|---|---|---|---|---|
| 3,483,367 | A * | 12/1969 | McCune et al. | 246/182 A |
| 3,515,867 | A * | 6/1970 | Seay | 246/182 A |
| 3,946,973 | A * | 3/1976 | Budway et al. | 246/182 BH |
| 4,610,206 | A | 9/1986 | Kubala et al. | |
| 5,676,337 | A * | 10/1997 | Giras et al. | 246/182 A |
| 5,758,848 | A * | 6/1998 | Beule | 246/182 B |
| 2009/0072096 | A1 * | 3/2009 | Ottow | 246/182 BH |

FOREIGN PATENT DOCUMENTS

| | | |
|---|---|---|
| DE | 1237608 B | 3/1967 |
| DE | 1530315 | 10/1969 |
| DE | 3019950 A1 | 12/1981 |
| DE | 10155896 C1 | 10/2002 |
| GB | 1237608 | 3/1967 |

OTHER PUBLICATIONS

Vantuono, William C.; "Fine-Tuning the Classyard"; Mar. 2009; Simmons Boardman Publishing Corp.; Railway Age; vol. 210 Issue 3; pp. 20-25.*

Siemens "Automatisierung fuer Zugsbildungsanlagen MSR32—Mehr Effizienz und Sicherheit im Gueterverkehr" Order No. A19100-V100-B898-V1, Siemens AG, 2010 [Trackguard Cargo MSR32 system for automation of train formation yards—Greater efficiency and safety in cargo transport], siemens.com/mobility.

* cited by examiner

METHOD FOR OPERATING A SWITCHING HUMP YARD, AND CONTROL DEVICE FOR A SWITCHING HUMP YARD

BACKGROUND OF THE INVENTION

Field of the Invention

In switching hump yards, cars or car groups (also referred to as cuts) are sorted from a hump track into different classification tracks using the force of gravity that acts on the cuts. For reasons of efficiency and reliability, the operation of the hump yard is usually automated to a large extent in this type of configuration. A suitable automatic control system for this purpose is disclosed, for example, in the company publication "Automatisierungssystem für Zugbildungsanlagen MSR32—Mehr Effizienz und Sicherheit im Güterverkehr", Order No. A19100-V100-B898-V1, Siemens AG, 2010. In this case, automatic speed adjustment of the cuts is achieved by controlling a lower main retarder accordingly, such that the entry speed of the cuts into the next braking stage, in the form of a classification track retarder, does not exceed a first threshold value of e.g. approximately 4 m/s. This ensures that adequate braking of the cuts can be achieved by the classification track retarder, this being disposed at the start of the respective classification track, under any circumstances normally occurring in practice.

BRIEF SUMMARY OF THE INVENTION

The object of the present invention is to specify a method for operating a switching hump yard, which method allows the performance of the respective hump yard to be improved.

This object is inventively achieved by a method for operating a switching hump yard, wherein, for the respective cuts in the form of rolling cars or car groups, at least one value for an entry speed into the first retarder is ascertained for a first retarder on the basis of a target release speed from the first retarder, at least one value for a release speed from a second retarder that lies uphill relative to the first retarder is determined for the second retarder on the basis of the ascertained at least one value for the entry speed into the first retarder, and the second retarder is controlled taking into account the determined at least one value for the release speed.

According to the first step of the inventive method, for the respective cuts in the form of rolling cars or car groups, at least one value for an entry speed into a first retarder is ascertained for the first retarder on the basis of a target release speed from the first retarder. According to the invention, the target release speed from the first retarder can be fixed or presentable for all cuts. Alternatively, the target release speed from the first retarder can be ascertained specifically for the respective cut.

In the context of the method according to the invention, the ascertained at least one value for the entry speed into the first retarder can be a single value, e.g. in the form of a maximal entry speed at which braking of the respective cut by the first retarder to the target release speed is still guaranteed. Alternatively, the at least one value for the entry speed may also consist of e.g. a plurality of discrete speed values or a speed range that is delimited by an upper entry speed and a lower entry speed.

According to the second step of the inventive method, at least one value for the release speed from a second retarder that lies uphill relative to the first retarder is now determined for the second retarder on the basis of the ascertained at least one value for the entry speed into the first retarder. This means that the at least one value for the release speed from the second retarder along the route "from bottom to top", i.e. from the classification tracks toward the hump, is calculated or determined. In contrast with the known method for controlling retarders, in which an identical target entry speed is assumed for all cuts, the at least one value for the release speed from the second retarder in this case is determined on the basis of the previously ascertained at least one value for the entry speed into the first retarder, i.e. on the basis of at least one specific value for the respective cut of the entry speed into the first retarder.

In the context of the method according to the invention, in the same way as the at least one value for the entry speed into the first retarder, the at least one determined value for the release speed from the second retarder can be a single speed value, a plurality of discrete values or even a speed range or speed band.

According to the third step of the inventive method, the second retarder is controlled taking into account the determined at least one value for the release speed. This means that the second retarder is so activated that the respective cut does not normally exceed a maximal permitted release speed at the end of the second retarder, and therefore compliance with the target release speed from the first retarder can ultimately be guaranteed by the first retarder.

In comparison with the known method, in which the target release speed is determined separately from brake to brake in each case, the inventive method therefore differs fundamentally and in particular to the effect that it provides for cross-brake determination of the release speed from the second retarder. By this means, it is possible advantageously to produce an overall optimization of the operation and hence the performance of the hump yard. For example, the inventive method can be used in this case to effect an optimization in relation to the running time of the respective cut. By allowing the braking to a low speed level which is customary for the classification tracks to take place as far downhill as possible, for example, light cuts can be released from the lower main retarder at high speed since it is known that only a comparatively small amount of kinetic energy has to be absorbed in the classification track retarder. This allows a shorter time spacing to be achieved between consecutive cuts, thereby ultimately allowing a higher hump throughput. This applies in particular to hump yards having asymmetrical sorting zones, i.e. significantly varying distances between lower main retarder and classification track retarder depending on the respective route, for example.

It should be noted that boundary conditions specific to the respective hump yard, e.g. in the form of maximal route traversal speeds, can also be taken into account when controlling the retarders.

The inventive method is preferably developed such that the at least one value for the entry speed into the first retarder is ascertained taking into account the retarding ability of the first retarder and taking into account properties of the respective cut. This is advantageous because it allows the retarders of the switching hump yard to be controlled in an optimal manner, taking into account the respective factors relating to the first retarder and the respective cut. In respect of the retarding ability of the first retarder, it is advantageously possible in this context to take specific aspects of the relevant retarder into account, e.g. the age of the brake or a faulty valve.

The inventive method can preferably be further developed such that the mass, the number of axles, the distribution of the mass over the axles and/or the running resistance are taken into account as properties of the respective cut. This is advantageous because the cited variables are those which significantly influence the running behavior of the respective cut and the braking force that may be necessary for braking.

According to a further particularly preferred embodiment of the inventive method, at least one measurement value relating to the respective cuts is captured in each case, and the retarding ability of the first retarder, which retarding ability is taken into account when ascertaining the at least one value for the entry speed into the first retarder, is adaptively corrected with reference to the at least one captured measurement value. In particular, the actual entry and release speeds into and from the respective retarder are preferably captured as measurement values in this case, and are used to adjust the retarding ability of the respective retarder on the basis of a comparison with recorded braking levels or states of the retarder. This has the advantage that changes in the retarding ability of the retarders, e.g. due to wear, are automatically taken into account during the control of the retarders and consistent reliability of the hump yard is therefore achieved.

Moreover, the inventive method can preferably also be designed such that a reduced retarding ability in comparison with the maximal retarding ability of the first retarder is taken into account when ascertaining the at least one value for the entry speed into the first retarder. This is advantageous in that e.g. systematic overloading of the first retarder, i.e. the retarder that lies downhill, can be prevented thereby. For example, the maximum available braking level and hence the effective braking energy or the respective retarding ability of the first retarder could conceivably be reduced by a factor in this context.

According to a particularly preferred development, the inventive method is embodied such that at least one value for an entry speed into the second retarder is ascertained on the basis of the determined at least one value for the release speed from the second retarder, at least one value for a release speed from a third retarder that lies uphill relative to the second retarder is determined for the third retarder on the basis of the ascertained at least one value for the entry speed into the second retarder, and the third retarder is controlled taking into account the determined at least one value for the release speed from the third retarder. The inventive method can therefore advantageously be applied to any number of retarders lying on the respective route of the respective cut. In this type of configuration, starting with the retarder lying furthest downhill in each case, at least one value for the entry speed into the relevant retarder is ascertained on the basis of the preset or determined release speed from the respective retarder, or the respective values for this release speed, and at least one value for the release speed from the next retarder in the direction of the hump is determined on the basis of this ascertained at least one value of the entry speed.

The inventive method is essentially suitable for controlling any retarders of switching hump yards.

According to a further particularly preferred embodiment of the inventive method, a second retarder in the form of a lower main retarder is controlled when a first retarder takes the form of a classification track retarder. This is advantageous because hump yards often have two corresponding braking stages. In this case a third retarder can take the form of a master retarder, for example, which is also known as an upper main retarder. Furthermore, gradient compensation retarders can also be taken into account in the context of the method, wherein these may be arranged in the region of the classification tracks depending on the respective embodiment of the hump yard.

The inventive method is moreover preferably designed such that a cut preceding the respective cut and/or following the respective cut is taken into account when controlling the second retarder. Taking into account the determined at least one value for the release speed, the second retarder can therefore advantageously be controlled in particular such that those cuts in respect of which a temporal conflict with a preceding cut arises or could arise, on the route between the second retarder and the first retarder, are braked in the second retarder such that they ultimately pass through the first retarder un braked in order to achieve the target release speed. This makes it possible to alleviate or even completely resolve the temporal conflict that has been identified, wherein the release speed from the second retarder is advantageously corrected or optimized if necessary, to the effect that a distance which is required between the cuts in order to prevent collisions of consecutive cuts and to set the points is guaranteed. It is consequently also possible in this case to reduce the time spacing of consecutive cuts and hence allow a higher hump throughput of the hump yard.

In respect of the control device for the switching hump yard, the object of the present invention is to specify a control device which allows the performance of the respective hump yard to be improved.

This object is inventively achieved by a control device for operating a switching hump yard, wherein, for the respective cuts in the form of rolling cars or car groups, said control device is so designed as to ascertain for a first retarder at least one value for an entry speed into the first retarder on the basis of a target release speed from the first retarder, to determine for a second retarder that lies uphill relative to the first retarder at least one value for a release speed from the second retarder on the basis of the ascertained at least one value for the entry speed into the first retarder, and to control the second retarder taking into account the determined at least one value for the release speed.

The advantages of the inventive control device correspond to those of the inventive method, and therefore reference is made to the corresponding foregoing explanations in this regard. The same applies to the preferred developments cited below for inventive control device, relative to the corresponding preferred developments of the inventive method, and therefore reference is likewise made to the corresponding foregoing explanations in this regard.

The inventive control device is preferably designed to ascertain the at least one value for the entry speed into the first retarder taking into account the retarding ability of the first retarder and taking into account properties of the respective cut.

According to an advantageous embodiment, the inventive control device is designed to take into account as properties of the respective cut the mass, the number of axles, the distribution of the mass over the axles and/or the running resistance.

According to a further particularly preferred development, the inventive control device is designed to capture in each case at least one measurement value relating to the respective cuts and adaptively to correct the retarding ability of the first retarder, said retarding ability being taken into account when ascertaining the at least one value for the entry speed into the first retarder, with reference to the at least one captured measurement value.

The inventive control device can preferably also be designed to take a reduced retarding ability in comparison with the maximal retarding ability of the first retarder into account when ascertaining the at least one value for the entry speed into the first retarder.

According to a particularly preferred development, the inventive control device is designed to ascertain at least one value for an entry speed into the second retarder on the basis of the determined at least one value for the release speed from the second retarder, to determine for a third retarder that lies uphill relative to the second retarder at least one value for a release speed from the third retarder on the basis of the ascertained at least one value for the entry speed into the second retarder, and to control the third retarder taking into account the determined at least one value for the release speed from the third retarder.

The inventive control device can advantageously also be embodied such that the control device is designed to take a cut preceding the respective cut and/or following the respective cut into account when controlling the second retarder.

Furthermore, the inventive control device is preferably developed such that the first retarder is a classification track retarder and the second retarder is a lower main retarder.

The invention is explained in greater detail below with reference to exemplary embodiments, wherein:

DESCRIPTION OF THE INVENTION

Figure 1:
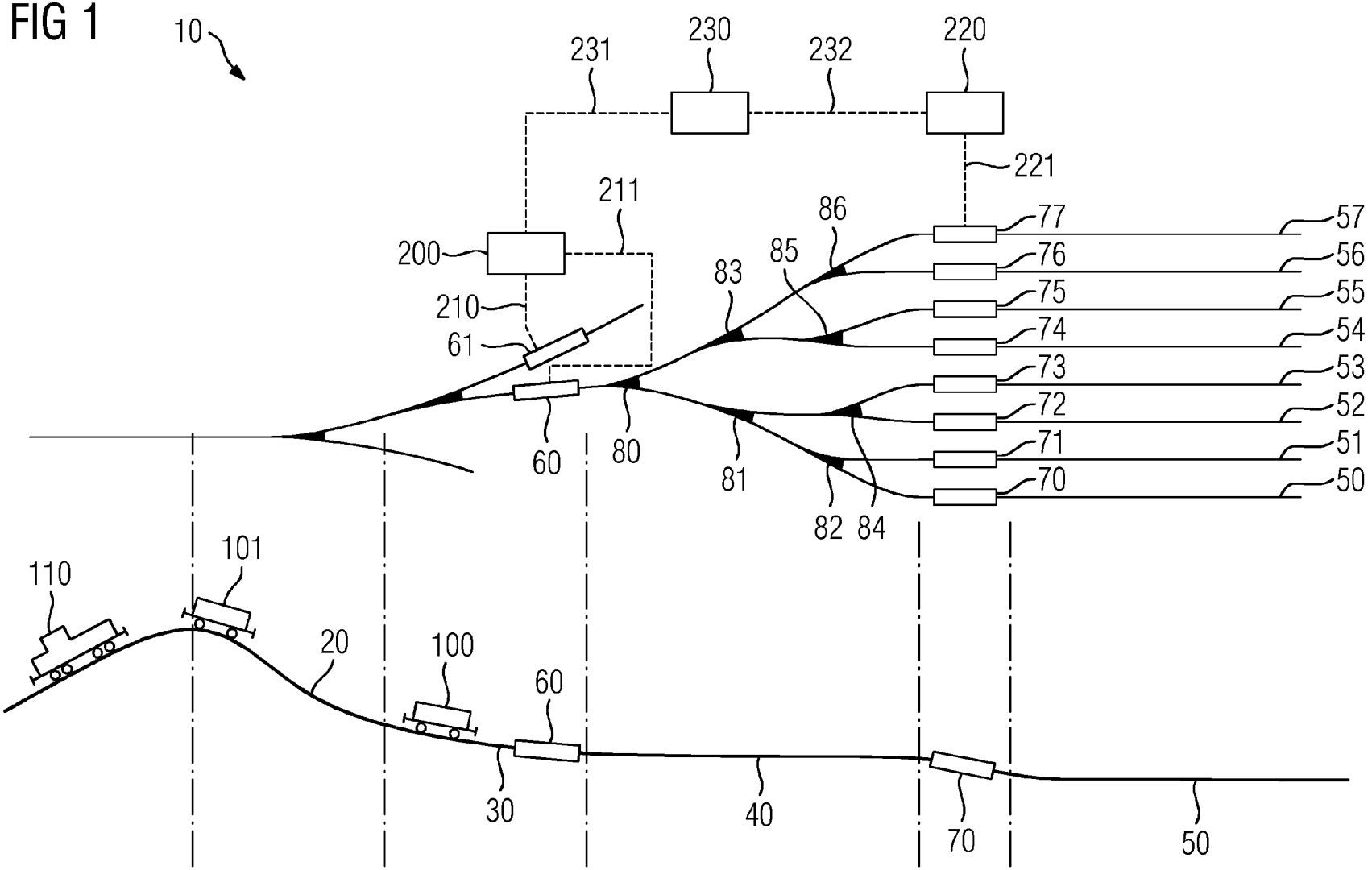
FIG. 1 shows a schematic diagram of an exemplary embodiment of a hump yard comprising an exemplary embodiment of the inventive control device.

FIG. 1 shows a schematic diagram of an exemplary embodiment of a hump yard 10 comprising an exemplary embodiment of the inventive control device. In this case, the upper part of FIG. 1 shows the track diagram of the hump yard 10 and the lower part of the figure shows the profile or a longitudinal section of the hump yard 10.

According to the illustration in FIG. 1, the hump yard 10 as part of a switching system for rail traffic has a hump ramp 20 which is connected to an intermediate slope 30, a sorting zone 40 comprising switching points 80 to 86, and classification tracks 50 to 57. Retarders in the form of lower main retarders 60, 61 and classification track retarders 70 to 77 are also shown in the figure.

In addition to the cited components of the hump yard 10, the figure also includes an exemplary illustration of cuts 100 and 101, which have been pushed or humped over the hump by a humping locomotive 110 and then move along the hump yard 10 under the influence of gravity.

For the purpose of controlling the retarders in the form of the lower main retarders 60 and 61, FIG. 1 also shows a lower main retarder control 200 which is linked to the lower main retarders 60, 61 via communication connections 210 and 211 that can be hard-wired or wireless. The classification track retarders 70 to 77 are linked via technical communication means to a classification track retarder control 220 correspondingly. For the sake of clarity here, only one corresponding communication connection 221 between the classification track retarder 77 and the classification track retarder control 220 is shown by way of example in FIG. 1. The lower main retarder control 200 and the classification track retarder control 220 are respectively connected via communication connections 231 and 232 to a central control apparatus 230 of the hump yard 10. This means that the components 200, 220 and 230 together form a control device in the form of a distributed control system for controlling the retarders in the form of the lower main retarders 60 and 61 and the classification track retarders 70 to 77. As an alternative to this, it would for example obviously also be possible for the lower main retarders 60, 61 and the classification track retarders 70 to 77 to be connected directly to the central control apparatus 230.

The control of the retarders in the form of the lower main retarders 60, 61 and the classification track retarders 70 to 77 of the hump yard 10 is now effected in accordance with an exemplary embodiment of the inventive method, such that a cross-brake approach and/or optimization of the respective speeds of the cuts 100, 101 is implemented. In the context of the exemplary embodiment described, it is assumed that the cut 100 here is destined for the classification track 50 and therefore passes or will pass through the lower main retarder 60 first and then the classification track retarder 70 on its route.

Starting from the retarder lying furthest downhill in the anticipated route of the cut 100, i.e. the classification track retarder 70, at least one value for an entry speed into the classification track retarder 70 is now ascertained for the classification track retarder 70 on the basis of a target release speed from the classification track retarder 70. It is assumed in this case that the target release speed from the classification track retarders 70 to 77 is fixed or preset to a uniform value of 1.5 m/s, for example. At least one value for the entry speed into the classification track retarder 70 is now—specifically before the cut 100 has reached the lower main retarder 60—ascertained or predicted on the basis of this target release speed from the first retarder in the form of the classification track retarder 70, taking into account the retarding ability of the first retarder in the form of the classification track retarder 70 and taking into account properties of the cut 100. Values thus ascertained for the entry speed preferably comprise a set of speed values or an entry speed value range that is delimited by a lower value and an upper value. The at least one ascertained value for the entry speed into the classification track retarder 70 is preferably selected specifically for the cut 100 in this case, i.e. taking into account e.g. the mass, the number of axles, the distribution of the mass over the axles and the running resistance of the cut 100, and such that it lies between a lower and an upper limit value. The lower limit value here is advantageously determined by a minimal speed which results in the cut 100 leaving the classification track retarder 70 at the target release speed without braking energy being output by the classification track retarder 70. Conversely, the upper limit value corresponds to a maximal speed at which braking of the cut 100 to the target release speed by the classification track retarder 70 is still reliably possible. In order here to prevent systematic overloading of the classification track retarder 70, i.e. continuous operation of the classification track retarder 70 in the region of its maximal performance, a reduced retarding ability in comparison with the maximal retarding ability of the classification track retarder 70 can be set or taken into account when ascertaining the entry speed into the classification track retarder 70. Furthermore, in order to take into account e.g. aging effects or faults of the classification track retarder 70, provision can be made for capturing measurement values, e.g. in the form of the entry speed and the release speed from the retarder in the form of the classification track retarder 70. It is then possible to perform an adaptive correction of the retarding ability of the classification track retarder 70, said retarding ability being taken into account when ascertaining the entry speed into the classification track retarder 70, on the basis of e.g. a statistical approach which takes into account recorded braking levels for a multiplicity of cuts over the course of time.

On the basis of the at least one value ascertained thus for the entry speed into the first retarder in the form of the classification track retarder 70, at least one value for a release speed from the second retarder that lies uphill relative to the classification track retarder 70 is now determined for the second retarder in the form of the lower main retarder 60. This means that those values which are determined for the release speed from the lower main retarder 60, preferably again taking into account properties of the relevant cut 100, ensure that the entry speed into the classification track retarder 70 lies in the region of the ascertained at least one value for the entry speed or does not exceed a maximal value for the entry speed if this has been ascertained.

By virtue of the method, it is therefore possible using a cross-brake approach to effect a control of the lower main retarder 60 taking into account the at least one value for the release speed from the lower main retarder.

It should be noted that the properties of the respective cut, which are taken into account in the context of the method, are preferably measured in the region of the hump or ascertained from corresponding measured variables.

In order to perform the method, in addition to hardware-based components in the form of e.g. corresponding processors and storage means, the control device comprising the central control apparatus 230, the lower main retarder control 200 and the classification track retarder control 220 also has software-based components in the form of e.g. program code for simulating the running behavior of the cuts 100, 101. It should be noted in this context that when controlling the lower main retarders 60, 61 and the classification track retarders 70 to 77, provision is preferably made for taking into account the cut 101 following the cut 100, and any cut that may have preceded the cut 100. In particular, the respective shared route of the cuts 100, 101 must be considered here in order to prevent catching-up and to allow the switching points 80 to 86 in the sorting zone 40 to be set reliably. Moreover, further boundary conditions such as e.g. maximal route traversal speeds can also be taken into account in the context of the method.

Figure 2:
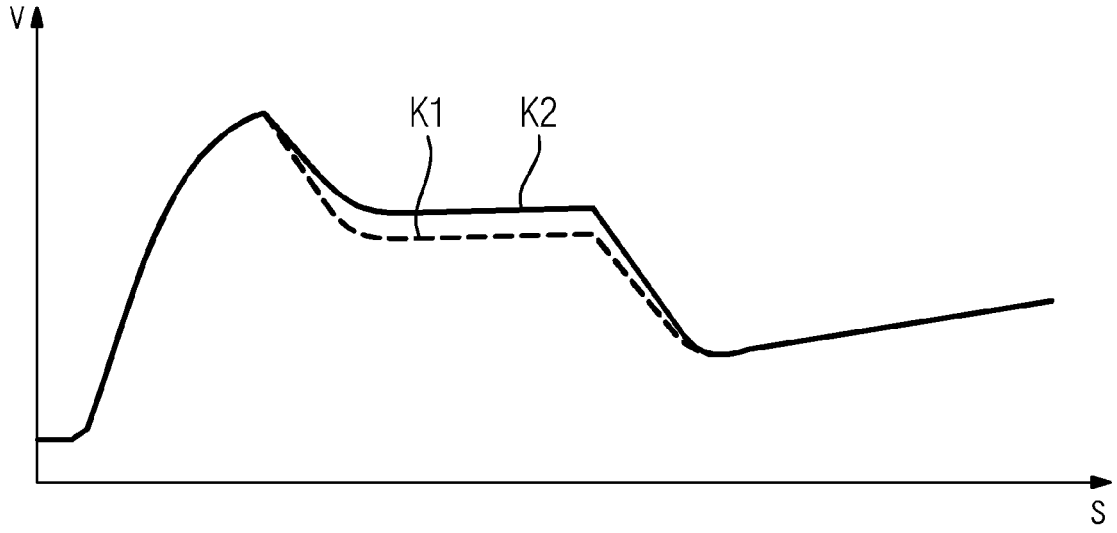
FIG. 2 shows a comparison, in an exemplary speed/time diagram, of the resulting curves for a cut with and without control of the retarders of a hump yard according to an exemplary embodiment of the inventive method.

FIG. 2 shows a comparison, in an exemplary speed/time diagram, of the resulting curves for a cut with and without control of the retarders of a hump yard according to an exemplary embodiment of the inventive method. Specifically, the speed v is shown as a function of the location s in the form of curves K1 and K2, the curve K2 resulting from an application of an exemplary embodiment of the inventive method and the curve K1 showing a comparison curve wherein the control of the retarders was effected exclusively from brake to brake in each case, i.e. not in the cross-brake manner described above.

In the schematic illustration according to FIG. 2, which shows the result of a corresponding simulation, it is evident that a higher speed of the cut 100 is produced by virtue of the inventive method in the region between the lower main retarder and the classification track retarder, the respective positions of which are characterized by a significant change in speed. Light cuts in particular can therefore be released at a higher speed from the lower main retarder, since it is known that only a comparatively small amount of kinetic energy has to be absorbed for them in the respective classification track retarder. This makes it possible to achieve a faster passage though the sorting zone and (in the case of a suitable preceding cut 100) a reduction of the time spacing between the consecutive cuts 100 and 101, thereby producing an increase in the hump throughput of the hump yard.

It should be noted that the advantages of the inventive method apply to asymmetrical hump yards in particular, where the sum of the running resistances varies significantly over different routes.

Figure 3:
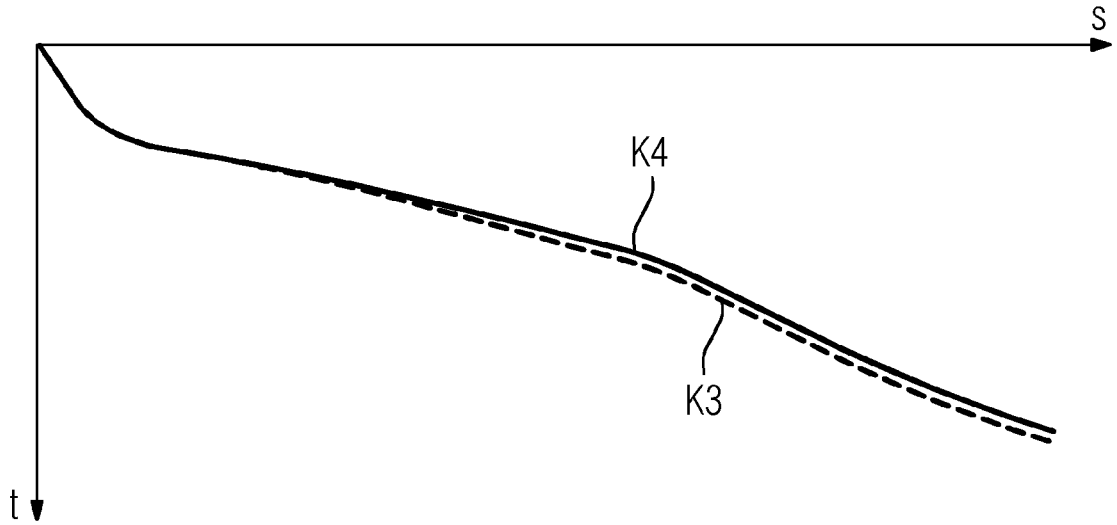
FIG. 3 shows a comparison, in an exemplary time/distance diagram, of the resulting curves for a cut with and without control of the retarders of a hump yard according to an exemplary embodiment of the inventive method.

FIG. 3 shows a comparison, in an exemplary time/distance diagram, of the resulting curves for a cut with and without control of the retarders of a hump yard according to an exemplary embodiment of the inventive method. Specifically, the time t is shown as a function of the location s in the form of curves K3 and K4, the curve K4 resulting from an application of an exemplary embodiment of the inventive method and the curve K3 again showing a comparison curve based on controlling the retarders exclusively from brake to brake in each case, i.e. not in a cross-brake manner. The temporal distance between the curves K3 and K4 at the respective location s represents the respective time gain that is achieved by virtue of the inventive method. It is therefore very clear from this likewise that the inventive method or the described exemplary embodiment of said method allows the respective cuts to pass through the hump yard more quickly.

It should be noted that, in contrast with the exemplary embodiments illustrated in the FIGS. 2 and 3, it is also possible to control the lower main retarder 60 in such way that a respective cut is released from the lower main retarder 60 at a release speed which is lower in comparison with the curve K1. In particular, this makes it possible to avoid temporal conflicts which may otherwise occur in relation to a preceding cut, i.e. in particular impending catch-up or insufficient time to set switching points. A resulting harmonization of the curves of leading car 100 and trailing car 101 on their shared route to the last shared clearance marker likewise ultimately allows the time spacing of consecutive cuts to be reduced, and hence the hump throughput of the hump yard to be increased.

In summary, it is therefore stated that the method described above and the corresponding control device for controlling retarders of a hump yard allow an overall optimization of the time spacing of the cuts by virtue of the cross-brake approach in respect of the respective entry speeds and target release speeds. In this way, in comparison with the case of a control that is based on a fixed entry speed into the next retarder, an optimization relating to the respective cut can be effected as a function of the current conditions, in particular taking into account preceding and/or following cuts, in terms of speeding up or slowing down the passage of the respective cut through the hump yard. This ultimately results in an increase in the performance of the respective hump yard, i.e. in particular the hump throughput of the system.

The invention claimed is:

1. A method of operating a switching hump yard having a first retarder and a second retarder uphill from the first retarder, the method comprising, for respective cuts in the form of rolling cars or car groups:

ascertaining at least one value for an entry speed of respective cuts into the first retarder based on a target release speed of the respective cuts from the first retarder;

determining at least one value for a release speed of the respective cuts from the second retarder based on the at least one value for the entry speed of the respective cuts into the first retarder; and controlling the second retarder taking into account the at least one value for the release speed of the respective cuts from the second retarder for establishing the release speed of the respective cuts.

2. The method according to claim 1, wherein the ascertaining step comprises taking into account a retarding ability of the first retarder and taking into account properties of the respective cut.

3. The method according to claim 2, which comprises taking into account a mass, a number of axles, a distribution of the mass over the axles, and/or a running resistance as properties of the respective cut.

4. The method according to claim 2, which comprises capturing least one measurement value relating to the respective cuts in each case, and adaptively correcting the retarding ability of the first retarder, which retarding ability is taken into account when ascertaining the at least one value for the entry speed into the first retarder, with reference to the at least one captured measurement value.

5. The method according to claim 2, which comprises taking into account a reduced retarding ability in comparison with a maximal retarding ability of the first retarder when ascertaining the at least one value for the entry speed into the first retarder.

6. The method according to claim 1, which comprises:

ascertaining at least one value for an entry speed into the second retarder on a basis of the determined at least one value for the release speed from the second retarder;

determining at least one value for a release speed from a third retarder disposed uphill relative to the second retarder based on the ascertained at least one value for the entry speed into the second retarder; and controlling the third retarder taking into account the determined at least one value for the release speed from the third retarder.

7. The method according to claim 1, wherein the second retarder is a lower main retarder and the first retarder is a classification track retarder.

8. The method according to claim 1, which comprises taking into account at least one of a cut that precedes and a cut that follows the respective cut when controlling the second retarder.

9. A control system for a switching hump yard having a first retarder and a second retarder, the control system, comprising:

a controller for respective cuts in the form of rolling cars or car groups, said controller being configured to:

ascertain, for a first retarder, at least one value for an entry speed into the first retarder based on a target release speed from the first retarder;

determine, for a second retarder disposed uphill relative to the first retarder, at least one value for a release speed from the second retarder based on the ascertained at least one value for the entry speed into the first retarder; and control the second retarder taking into account the determined at least one value for the release speed from the second retarder.

10. The control device according to claim 9, wherein the control device is configured to ascertain the at least one value for the entry speed into the first retarder taking into account a retarding ability of the first retarder and taking into account properties of the respective cut.

11. The control device according to claim 10, wherein the control device is configured to select the properties of the respective cut from the group consisting of a mass, a number of axles, a distribution of the mass over the axles, and a running resistance.

12. The control device according to claim 10, wherein the control device is configured to capture in each case at least one measurement value relating to the respective cuts, and to adaptively correct the retarding ability of the first retarder, the retarding ability being taken into account when ascertaining the at least one value for the entry speed into the first retarder, with reference to the at least one captured measurement value.

13. The control device according to claim 10, wherein the control device is configured to take into account a reduced retarding ability in comparison with the maximal retarding ability of the first retarder when ascertaining the at least one value for the entry speed into the first retarder.

14. The control device according to claim 10, wherein the control device is configured to:

ascertain at least one value for an entry speed into the second retarder based on the at least one value for the release speed from the second retarder;

determine for a third retarder that lies uphill relative to the second retarder at least one value for a release speed from the third retarder based on the ascertained at least one value for the entry speed into the second retarder; and to control the third retarder taking into account the determined at least one value for the release speed from the third retarder.

15. The control device according to claim 10, wherein the control device is configured to take into account at least one of a cut that precedes the respective cut and a cut that follows the respective cut when controlling the second retarder.

* * * * *